US006334475B1

(12) United States Patent
Schultheiss

(10) Patent No.: US 6,334,475 B1
(45) Date of Patent: Jan. 1, 2002

(54) PENCIL SHARPENER

(75) Inventor: Thomas Schultheiss, Weitramsdorf (DE)

(73) Assignee: Wilhelm Dahle Büro-technik GmbH & Co. KG, Coburg (DE)

( * ) Notice: Subject to any disclaimer, the term of this patent is extended or adjusted under 35 U.S.C. 154(b) by 0 days.

(21) Appl. No.: 09/581,848

(22) PCT Filed: Nov. 26, 1998

(86) PCT No.: PCT/EP98/07649

§ 371 Date: Aug. 21, 2000

§ 102(e) Date: Aug. 21, 2000

(87) PCT Pub. No.: WO99/32306

PCT Pub. Date: Jul. 1, 1999

(30) Foreign Application Priority Data

Dec. 18, 1997 (DE) ..... 197 56 399

(51) Int. Cl.[7] ..... B43L 23/02
(52) U.S. Cl. ..... 144/28.71; 144/28.1; 144/28.6
(58) Field of Search ..... 144/28.1, 28.3, 144/28.6, 28.71; D19/74

(56) References Cited

U.S. PATENT DOCUMENTS 3,227,140 A 1/1966 Brand ..... 144/28.71

FOREIGN PATENT DOCUMENTS

| | | | |
|---|---|---|---|
| CH | 181 271 | 12/1935 | |
| DE | 396 839 | 6/1924 | |
| DE | 472 725 | 3/1929 | |
| DE | 1 063 934 | 8/1959 | |
| DE | 2 015 683 | 12/1971 | |
| DE | 808425 | * 7/1991 | ..... 144/28.71 |
| FR | 873 053 | 6/1942 | |

* cited by examiner

*Primary Examiner*—W Donald Bray
(74) *Attorney, Agent, or Firm*—Venable; Gabor J. Kelemen; Catherine M. Voorhees

(57) ABSTRACT

The invention relates to a pencil sharpener, comprising a clamping chuck (1) that feeds a pencil rotationally fixed therein to a rotating milling device. The clamping chuck (1) comprises a plurality of locating tongues (8) pointing almost radially towards a clamp chuck axis (4) to fix the pencil, said tongues being connected to a holding frame(7) surrounding the clamp chuck axis (4) in such a way that they cannot rotate. When the holding frame (7) is pivoted around the clamp chuck axis (4), the locating tongues (8) are bent in the form of a unilaterally tensed bar spring and interacting with stops (15) of a clamp chuck housing (2, 3). The radial inner locating ends (10) of the locating tongues (8) are pivoted outwards to open the clamp chuck (1). The restoring tension of the bent locating tongues (8) is simultaneously used as closing tension for the clamp chuck (1).

7 Claims, 3 Drawing Sheets

PENCIL SHARPENER

BRIEF DESCRIPTION OF THE INVENTION

The invention relates to a pencil sharpener having a clamping chuck for clamping in a pencil to be sharpened coaxial to a clamping chuck axis by means of radially extending positioning tongues, which clamping chuck is positioned inside a clamping chuck housing, wherein the positioning tongues of the clamping chuck can be released jointly from the pencil through a pivoting movement counter to a spring pressure. The use of the word "pencil" as a tool to be clamped in by the clamping chuck of the pencil sharpener in this case refers not only to pencils or colored pencils, but also to cosmetic pencils, leads or similar pencil-shaped articles.

With pencil sharpeners of this type, which are known from German Unexamined Application 2 015 683 as well as U.S. Pat. No. 3,227,140, the pencil is held rotationally fixed in the clamping chuck while the milling devices are driven so as to rotate around the pencil tip. The rotational drive is either motorized or manual. For this, the clamping chuck is guided such that it can move in an axial direction inside an axially displaceable clamping chuck housing, on the machine housing that contains the milling devices. The clamping chuck housing is admitted in the process with spring tension, effective in axial direction toward the milling devices, such that the pencil tip is fed automatically in axial direction to the rotational plane of the rotating milling devices.

With known pencil sharpeners, the clamping chuck has a multi-part design and is therefore expensive to produce. The positioning tongues are positioned individually such that they can pivot around axes that are permanently attached to the clamping chuck housing. The outer actuation ends are operationally connected to a separate holding frame that encircles the clamping chuck axis in the manner of a ring. This holding frame is positioned such that it can pivot around the clamping chuck axis inside the clamping chuck housing and counter to a torsion spring that is effective in a circumferential direction. By pivoting the holding frame counter to the torsion spring pressure, the holding ends of the positioning tongues open the clamping chuck and the pencil can be removed easily. The fact that the holding frame is admitted in a circumferential direction by the torsion spring causes the holding ends of the positioning tongues to automatically pivot back to the clamping position relative to an inserted pencil or to a closed position near the axis.

A similar clamping chuck for a pencil sharpener is known from German Published Application 1 063 934. However, in place of a torsion spring this patent provides for several helical springs, which extend in circumferential direction and admit the holding frame. Another clamping chuck for a pencil sharpener is known from German Patent 472 725. The clamping chuck in this application is formed by several levers, which are positioned pivoting around axes permanently attached to the housing and extend approximately tangential to a lead-through for the pencil. In the region of the lead-through, each lever is provided with a clamping jaw that projects into the lead-through if the clamping chuck is in the closed position. The levers hereby engage with their outer ends in recesses, provided in a clamping chuck lid that can be pivoted, so that during the turning of the lid, the clamping jaws that are held together by spring force are pulled apart approximately in radial direction. These known clamping chucks again have the disadvantage of a multipart design and are therefore expensive to produce.

SUMMARY OF THE INVENTION

It is an object of the invention to simplify the design of a pencil sharpener of the aforementioned type. The effect achieved in prior art with a multipart design, for which the parts can be rotated or moved relative to each other, is achieved according to the invention simply with the holding frame and the positioning tongues, which are attached thereto in such a way that they can neither rotate nor move. A separate torsion spring that is effective in circumferential direction is not required because its effectiveness is replaced by the positioning tongues, which are secured on the holding frame in the manner of unilaterally tensed bar springs and by the fact that these positioning tongues rest against locally fixed stops on the clamping chuck housing.

A one-piece design of the holding frame and positioning tongues according to the invention is particularly advantageous. The use of polyoxymethylene (POM) as material for the one-piece clamping chuck according to the invention ensures a continued elasticity of the positioning tongues over a long period of time.

A preferred arrangement of the pencil sharpener according to the invention has the clamping chuck, in the idle position, inside the pivoting guide of the clamping chuck housing and the positioning tongues are not tensioned. This arrangement permits a particularly easy assembly of the clamping chuck, since it must not be inserted - as is standard practice—under pre-stressing into the clamping chuck housing.

The clamping chuck according to the invention preferably can be handled with one hand.

According to another embodiment of the invention, a large degree of design freedom for the holding frame is permitted without influencing the forming freedom, the spring behavior and the pivoting ability of the positioning tongues. This is particularly advantageous because the positioning tongues are secured on the holding frame and, in particular, are produced as one piece with the holding frame.

The spring characteristic of a positioning tongue can be adjusted easily according to an embodiment of the invention by dimensioning its cross-sectional surface in the individual longitudinal areas of the positioning tongue. In the process, the connecting region between positioning tongue and holding frame, in particular, can be protected against high torsional stress that damages the material.

BRIEF DESCRIPTION OF THE DRAWINGS

One exemplary embodiment of the invention is described with the aid of the accompanying Figures in which.

Figure 6:
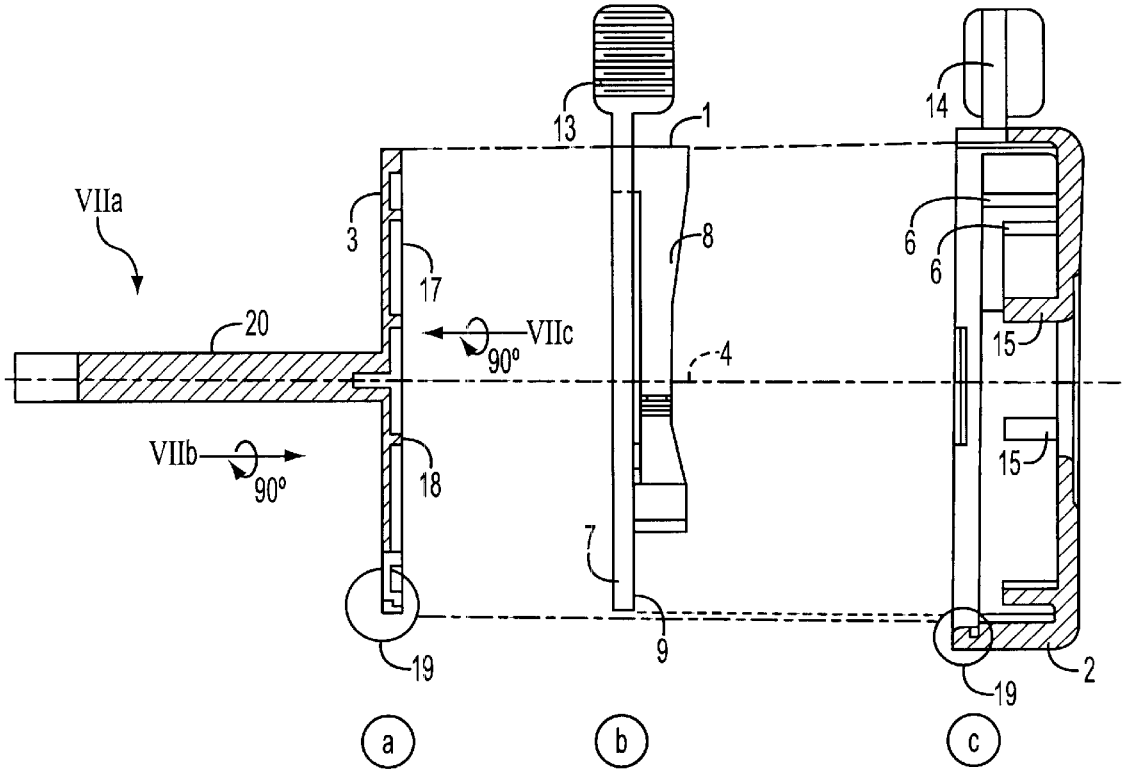
FIG. 6 is a sectional view from the side of individual parts of the clamping chuck housing in an exploded view, namely.
Figure 7A:
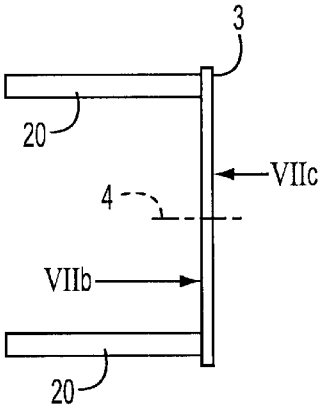
Figure 7B:
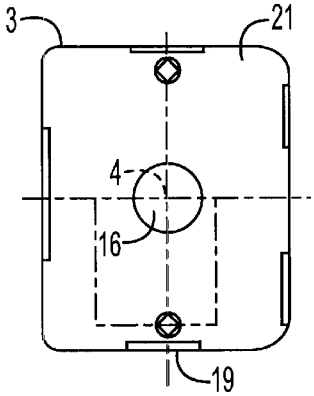
Figure 7C:
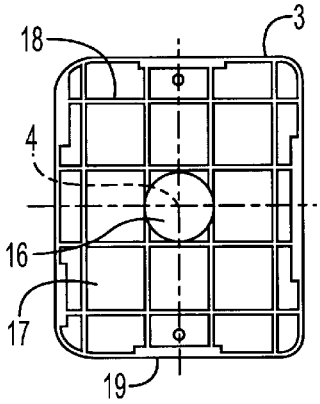

a) the inner shell with formed-on axial guide;

b) the actual clamping chuck, consisting of holding frame and positioning tongues, as well as c) the outer shell; and FIG. 7 shows the inner shell of the clamping chuck housing:

a) a view from the side with formed-on axial guide, as seen in arrow direction VIIa of FIG. 6;

b) a view from above of its outside surface as seen in arrow direction VIb of FIGS. 6 and 7*a;* c) a view from above of its inside surface facing the clamping chuck, according to the arrow VIIc of FIG. 7*a.*

DETAILED DESCRIPTION OF THE INVENTION

Figure 1:
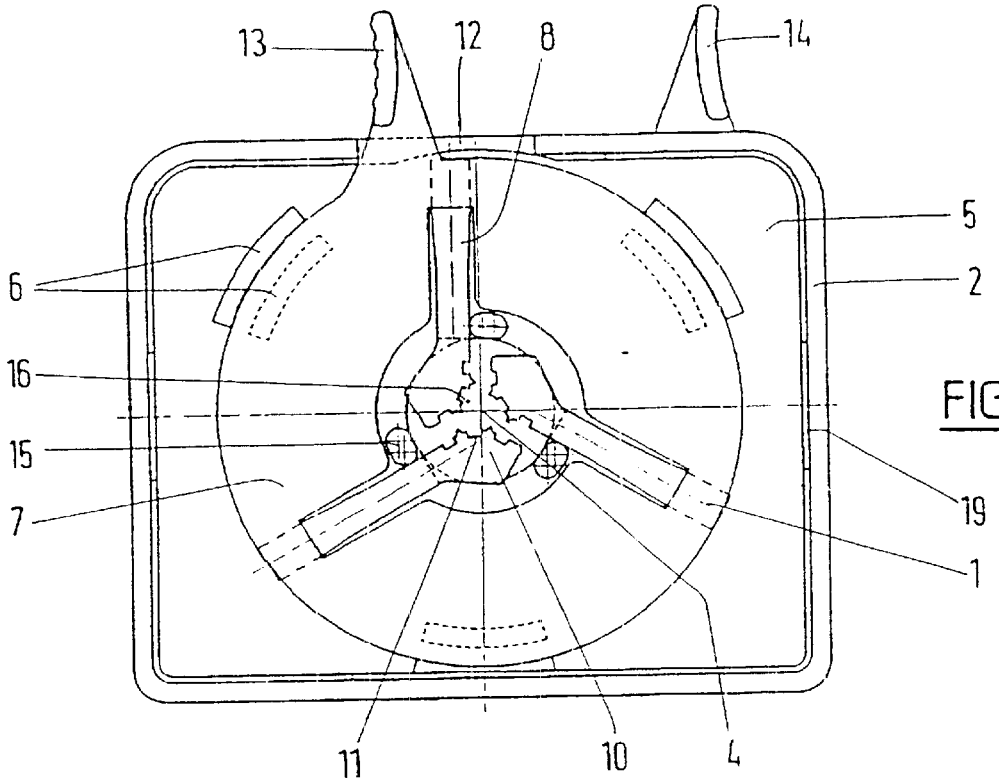
FIG. 1 is a view from above of the inside of the outer shell of the clamping chuck housing, with the holding frame inserted in the idle position.
Figure 2:
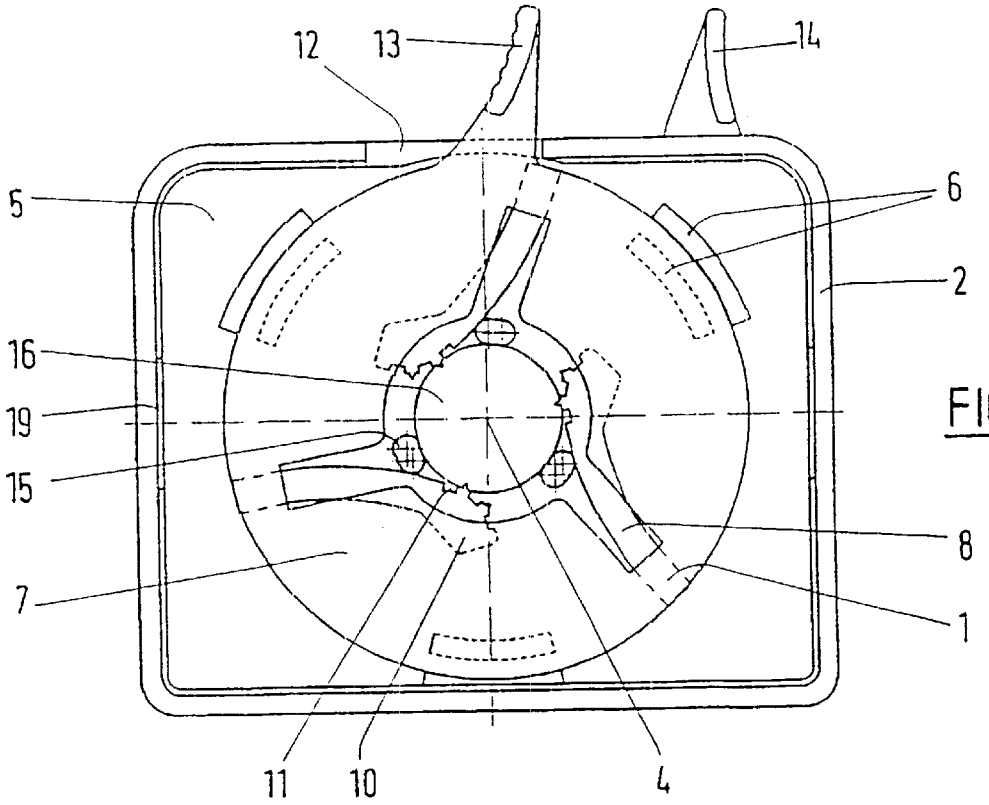
FIG. 2 is a view from above similar to FIG. 1 with the holding frame pivoted into the opened position of the clamping chuck.
Figure 3:
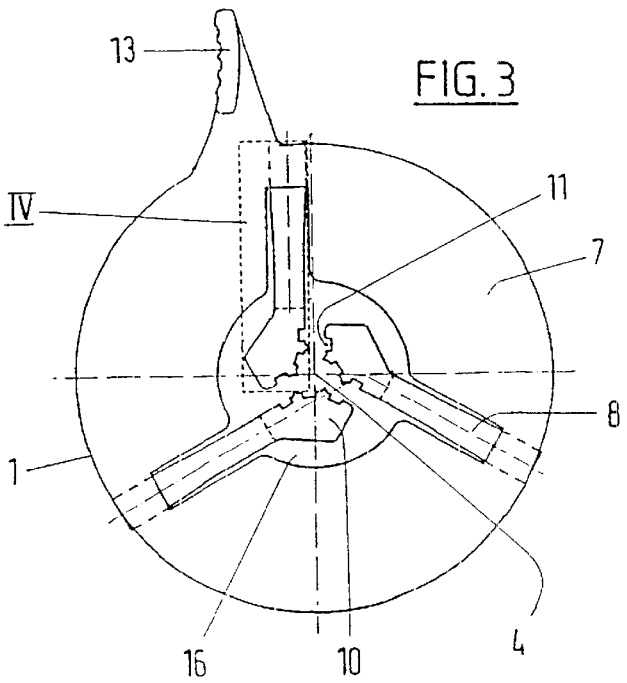
FIG. 3 is a view from above similar to FIG. 1, showing only the one-piece holding frame with the formed-on positioning tongues.
Figure 4:
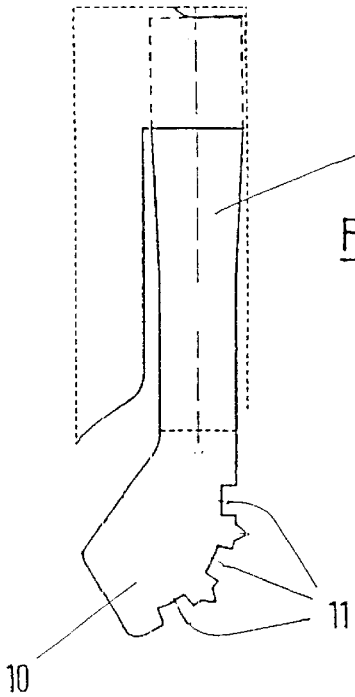
FIG. 4 shows detail IV from FIG. 3 in enlarged form which represents the area where a positioning tongue is attached to the holding frame.
Figure 5:
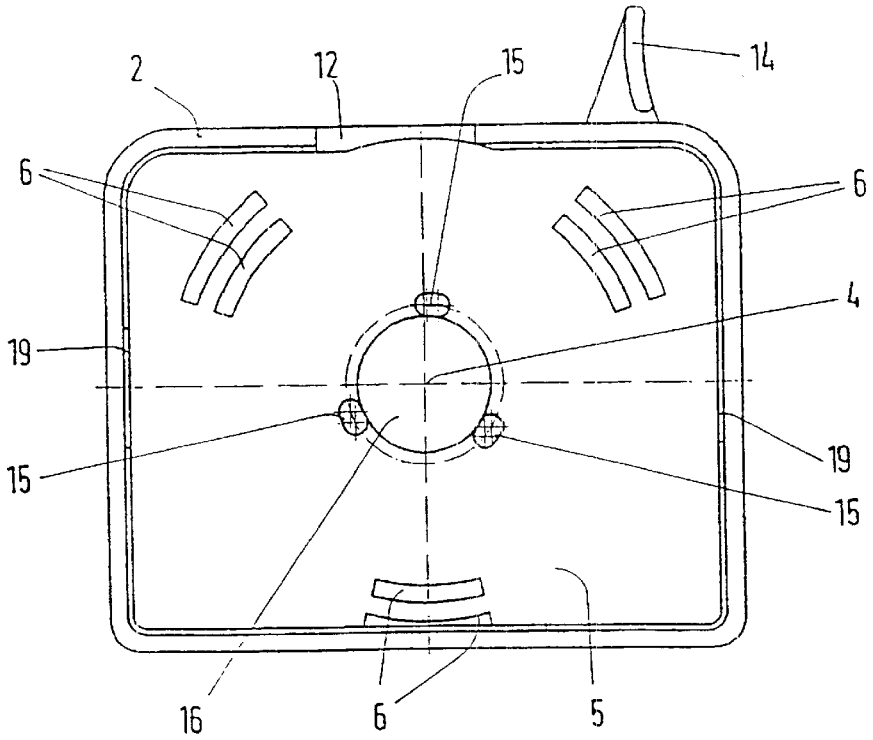
FIG. 5 is a view from above, similar to FIGS. 1 and 2, of the bare inside wall of the outer shell of the clamping chuck housing.

As shown in FIGS. 1 and 2, the pencil sharpener according to the invention comprises a clamping chuck 1, which is positioned around a clamping chuck axis 4 in a trough-shaped portion of a clamping chuck housing 2, 3 that is embodied as an outer shell 2. In order to illustrate this clearly, the clamping chuck 1 and the outer shell 2 are shown individually in FIGS. 3 and 5, respectively, as well as in FIG. 6. The clamping chuck housing 2, 3 is closed off approximately in the drawing plane by an inner shell 3 that is not shown in FIG. 1. The terms radial and axial are respectively used with reference to the clamping chuck axis 4.

The clamping chuck 1 is positioned on axial projections 6, installed on the inside wall 5 of outer shell 2. These axial projections rest in the circumferential area against an essentially circular-disk shaped holding frame 7 of clamping chuck 1. Approximately bar-shaped positioning tongues 8 with a rectangular cross section are formed onto the holding frame 7 in the circumferential area, meaning they are offset against the contact surfaces of the axial projections 6. For this, a positioning tongue 8 with a section of one side surface is placed onto a front surface 9 of the holding frame 7, at a short distance, and from there projects essentially radially toward the clamping chuck axis 4. With respect to its cross-sectional height, meaning its expansion in the axial direction, the positioning tongue 8 is tapered in a wedge shape, as can be seen in FIG. 6*b.* The radially extending inside holding ends 10 of the positioning tongues 8, which are widened in circumferential direction, are shown positioned close to each other in the idle position of clamping chuck 1, which is shown in FIG. 1. In order to increase the gripping ability, the radially inward pointing surfaces of positioning tongues 8 are provided with holding grooves 11.

The holding frame 7 is positioned with the aid of the axial projections 6, such that it can be pivoted over a limited angle interval around the clamping chuck axis 4. The extreme positions of holding frame 7, which correspond to the closed position and the open position of clamping chuck 1, are shown in FIGS. 1 and 2, respectively. In order to stimulate the opening movement for clamping chuck 1 and the connected pivoting of the holding frame 7, an opening lever 13 is attached to this holding frame, which projects through a slot 12 in the clamping chuck housing 2, 3. The length of slot 12 is limited by the maximum pivoting distance of holding frame 7. A projection functioning as a counter stop 14 is attached at a distance in the pivoting direction to the outside of outer shell 2, opposite the opening lever 13.

In the idle position, each positioning tongue 8 is relaxed and rests against a stop 15 that projects from the inside wall 5 of outer shell 2. The stop 15 is positioned in such a way that it makes contact with the positioning tongue 8 near the holding end 10, at the surface pointing in the pivoting direction. During the pivoting of the holding frame 7 and the therewith connected positioning tongue 8, the positioning tongue 8 is elastically deformed in the manner of a unilaterally tensioned bar spring by the stop 15, which projects into the pivoting path. This bending occurs in a parallel plane in front of the plane for holding frame 7. As a result, the holding end 10 is deflected radially toward the outside, as can be seen in FIG. 2, and the clamping chuck 1 is in the open position.

Following this, a pencil to be sharpened can be inserted into the clamping chuck 1 through a lead-through 16, which is provided in the clamping chuck housing 2, 3 as well as in the holding frame 7. Following the release of the opening lever 13, the clamping chuck 1 automatically pivots back to the closed position, driven by the resetting force of the bent positioning tongues 8. In the process, the inserted pencil is clamped locally and rotationally fixed into the clamping chuck 1 by the holding ends 10 that strive to return, so that it is positioned coaxial to clamping chuck axis 4.

FIG. 6 illustrates the steps for the assembly: According to FIG. 1, the clamping chuck 1 is initially inserted along the dashed lines into the outer shell 2. Following this, the outer shell is closed off by the inner shell 3. The inner shell 3 has an essentially planar design according to FIG. 7 and contains a network of reinforcing webs 18 on its inside wall 17. The outer shell 2 and the inner shell 3 are connected in the standard way by a snap connection 19.

The clamping chuck housing 2, 3 is guided by way of an axial guide 20, such that it is axially movable on a non-depicted machine housing that contains the milling devices. This axial guide 20 is formed as one piece onto the outside wall 21 of the inner shell 3.

What is claimed is:

1. A pencil sharpener, comprising:

a clamping chuck having a clamping chuck axis, radially extending positioning tongues for clamping a pencil to be sharpened coaxial to the clamping chuck axis, and a holding frame, said holding frame being pivotable around the clamping chuck axis and encircling the clamping chuck axis at a distance, said radially extending positioning tongues having one end rigidly mounted to the holding frame and a holding end, radially extending from the mounted end, wherein said positioning tongues pivot with the holding frame in a pivoting path, and can be released jointly from a clamped pencil through a pivoting movement counter to a spring pressure; and a clamping chuck housing in which said clamping chuck is positioned, said clamping chuck housing having stops that project axially into the pivoting path of the positioning tongues and act as unilaterally tensioned bar springs elastically deforming said positioning tongues from the clamping position when said holding frame is pivoted relative to the clamping chuck housing such that the holding ends are deflected toward the outside and release a clamped pencil.

2. A pencil sharpener according to claim 1, wherein the positioning tongues and the holding frame are made of a one-piece, flexible plastic material.

3. A pencil sharpener according to claim 2, wherein the holding frame and the positioning tongues are made of polyoxymethylene.

4. A pencil sharpener according to claim 1, wherein the clamping chuck in an idle position, in which the positioning tongues are not tensioned, is positioned inside the pivoting guide of clamping chuck housing.

5. A pencil sharpener according to claim 1, wherein the holding frame forms an approximately circular ring and is positioned such that it can rotate within a limited angular area around the clamping chuck axis.

6. A pencil sharpener according to claim 1, further comprising an opening lever that essentially projects radially from the clamping chuck housing, wherein the holding frame pivots when said opening lever is moved.

7. A pencil sharpener according to claim 6, further comprising a housing projection that is effective as a counter stop for the pivoting movement of the holding frame, the housing projection being arranged at a circumferential distance from the opening lever on the outside of clamping chuck housing.

* * * * *